US006766785B2

(12) United States Patent
Ishida et al.

(10) Patent No.: US 6,766,785 B2
(45) Date of Patent: Jul. 27, 2004

(54) ELECTRONIC THROTTLE CONTROL APPARATUS

(75) Inventors: Katsumi Ishida, Obu (JP); Hiroyuki Makisako, Obu (JP); Yoshiyasu Itoh, Toyota (JP)

(73) Assignee: Aisan Kogyo Kabushiki Kaisha, Obu (JP)

( * ) Notice: Subject to any disclaimer, the term of this patent is extended or adjusted under 35 U.S.C. 154(b) by 81 days.

(21) Appl. No.: 10/282,195

(22) Filed: Oct. 29, 2002

(65) Prior Publication Data

US 2003/0084873 A1 May 8, 2003

(30) Foreign Application Priority Data

Nov. 2, 2001 (JP) ..... 2001-337604

(51) Int. Cl.[7] ..... F02D 9/02
(52) U.S. Cl. ..... 123/399; 123/361
(58) Field of Search ..... 123/399, 361

(56) References Cited

U.S. PATENT DOCUMENTS 3,700,996 A * 10/1972 Gutting ..... 123/361
4,823,749 A * 4/1989 Eisenmann et al. ..... 123/361
4,901,695 A * 2/1990 Kabasin et al. ..... 123/399
4,955,346 A * 9/1990 Kaneyasu et al. ..... 123/361
5,345,907 A * 9/1994 Matsuoka ..... 123/399
5,746,178 A * 5/1998 Susaki et al. ..... 123/399
5,852,996 A * 12/1998 Nakamura et al. ..... 123/399
2003/0226542 A1 * 12/2003 Hoshino et al. ..... 123/399

FOREIGN PATENT DOCUMENTS

JP A 10-176579 6/1998

* cited by examiner

*Primary Examiner*—Erick Solis
(74) *Attorney, Agent, or Firm*—Oliff & Berridge, PLC

(57) ABSTRACT

An electronic throttle control apparatus is provided with an electronic throttle (1) including a throttle valve (4) which is opened and closed by a motor (5), and a microcomputer (11) which controls the motor (5). The microcomputer (11) calculates a deviation between a target opening degree which is set by detection of an accelerator sensor (5) and an actual opening degree which is detected by a throttle sensor (6) to calculate a motor control amount in accordance with the deviation and a control gain in correspondence to the deviation. The microcomputer 11 sets a control gain which becomes smaller as the deviation becomes larger, and limits the control gain by the previous control gain at a time when the control gain is larger than the previous control gain. The microcomputer (11) cancels the limit of the control gain when the calculated actual opening degree change is reduced from a predetermined value.

10 Claims, 12 Drawing Sheets

ELECTRONIC THROTTLE CONTROL APPARATUS

BACKGROUND OF THE INVENTION

1. Field of the Invention

The present invention relates to an electronic throttle control apparatus adapted to drivingly open and close a throttle valve disposed in an intake passage by means of an actuator in a gasoline engine or a diesel engine.

2. Description of Related Art

There has conventionally been known an electronic throttle control apparatus which is used in a gasoline engine or a diesel engine for a motor vehicle and others. This electronic throttle control apparatus is provided with an electronic throttle including a throttle valve of a linkless type which is disposed in an intake passage in the engine and is drivingly opened and closed by an actuator such as a motor and a controller for controlling the actuator. This controller determines a target opening degree of the electronic throttle (namely, the throttle valve) based on an operated amount of an accelerator pedal operated by a driver. The controller makes feedback control on the actuator by PID control and the like based on a deviation of opening degree between the determined target opening degree and an actual opening degree of the throttle valve detected by a throttle sensor, thereby controlling the electronic throttle so that the actual opening degree approaches the target opening degree.

In the above electronic throttle apparatus, a response and a stable convergence in operations of the electronic throttle often become problems. One of techniques taking those points into consideration is disclosed in Japanese patent unexamined publication No. 10-176579, which is entitled "Throttle valve control apparatus".

In this control apparatus, a controller determines a driving signal (=a control amount) of a throttle valve based on the product obtained by multiplying an opening degree deviation between a requested opening degree (=a target opening) and an actual opening degree of the throttle valve by a control coefficient (=a control gain). The controller has previously stored data on control coefficients (proportional gains and integrating gains) determined according to an opening degree deviation. The data is set such that the smaller the opening degree deviation is, the larger control coefficient is determined. The controller provisionally determines a control coefficient with reference to the above data if the throttle valve opening degree is in a transitional state at the time when the controller receives a signal representing an opening degree deviation. The controller then compares the provisionally determined value of control coefficient with a control coefficient value used in a previous cycle to select a smaller one. The controller calculates a value of a driving signal by multiplying the opening degree deviation by the selected control coefficient. The controller controls the motor based on the calculated value of the driving signal to drivingly open and close the throttle valve.

The above control is explained in detail with reference to a flowchart in FIG. 11. The controller first calculates an opening degree deviation ER between a target opening degree RTA and an actual opening degree VTA in a step 200 and calculates an absolute value (an absolute opening degree deviation) AER of the opening degree deviation ER in a step 201.

In a step 202, the controller determines whether or not the absolute opening degree deviation AER is smaller than a predetermined value A1. If an affirmative decision is made in the step 202, the controller determines that the throttle opening degree is in a steady state and, in a step 220, sets a gain KPb for a steady operation as a final proportional gain KP. In a step 221, the controller sets a gain KIb for the steady operation as a final integrating gain KI and advances the flow to a step 209.

If a negative decision is made in the step 202, on the contrary, the controller determines that the throttle opening degree is in a transitional state and, in the step 203, calculates a proportional gain tKP from the absolute opening degree deviation AER by referring to a proportional gain map (Map 1). In a step 204, the controller calculates an integrating gain tKI from the absolute opening degree deviation AER by referring to an integrating gain map (Map 2). These proportional gain tKP of the proportional gain map and the integrating gain tKI of the integrating gain map have both been set to become smaller as the absolute opening degree deviation AER becomes larger.

In a step 205, the controller then determines whether or not the proportional gain tKP calculated at this time is larger than the final proportional gain KP used at a previous time. If an affirmative decision is obtained in the step 205, the controller advances the flow directly to a step 207. If a negative decision is obtained, on the contrary, the controller updates the final proportional gain KP by the proportional gain tKP calculated at this time and then advances the flow to the step 207. More specifically, since this-time absolute opening degree deviation AER is larger than the previous absolute opening degree deviation AER, the proportional gain tKP which is smaller than the previous final proportional gain KP is selected as this-time final proportional gain KP. This is referred to as "minimum select".

In a step 207 following the step 205 or 206, the controller determines whether or not the integrating gain tKI calculated at this time is larger than the final integrating gain KI used at a previous time. If an affirmative decision is made, the controller advances the flow directly to a step 209. If a negative decision is made in a step 208, the controller updates the final integrating gain KI by the integrating gain tKI calculated at this time and then advances the flow to the step 209. More specifically, since this-time absolute opening degree deviation AER is larger than the previous absolute opening degree deviation AER, the integrating gain tKI which is smaller than the previous final integrating gain KI is selected as this-time final integrating gain KI. In other words, the "minimum select" is conducted.

In the step 209 following the step 207, 208, or 221, the controller calculates a proportional term VP by multiplying this-time final proportional gain KP by the opening degree deviation ER obtained at this time. In a step 210, the controller calculates an integral term VI by adding the product of this-time final integrating gain KI and this-time opening degree deviation ER to an addition result accumulated up to the previous time. In a step 211, the controller furthermore calculates a PI control amount (controlled variable) VPI by adding the proportional term VP calculated at this time and the integral term VI. In a step 212, the controller converts the PI control amount VPI calculated at this time to a duty ratio DUTY by using a predetermined function expression.

In a step 213, the controller then controls the motor based on the converted duty ratio DUTY to drivingly open and close the throttle valve.

The feature of the above routine is in determination of the final proportional gain KP and the final integrating gain KI by way of the "minimum selects". This can be shown by a block diagram in FIG. 12. In a block B1, the controller first calculates the opening degree deviation between the target opening degree and the actual opening degree. In a block B2, the controller calculates the control gain according to the opening degree deviation. In a block B3, the controller executes the minimum select to select a smaller one of the calculated control gains. In a block B4, then, the controller determines the control gain obtained by the minimum select as the final control gain.

More specifically, the conventional throttle valve control apparatus has stored the proportional gain tKP and the integrating gain tKI corresponding to the absolute opening degree deviation AER in the form of map. However, even if the absolute opening degree deviation AER is reduced by the motion of the throttle valve, the final proportional gain KP and the final integrating gain KI are not changed when the absolute opening degree deviation AER changes to a smaller value. This makes it possible to achieve high levels of both a response as the absolute opening degree deviation AER is small and a stable convergence as the absolute opening degree deviation AER is large, so that the throttle valve is appropriately driven regardless of operational status.

In the conventional throttle valve control apparatus, however, the response characteristics of the control apparatus may vary delicately by a product variance, a deterioration with age, or a change in temperature condition during operation, etc. Consequently, under such circumstances that the throttle valve temporarily slows down or stops during motion, the final proportional gain KP and the final integrating gain KI are maintained as small values by the minimum select. As a result, it would take much time to converge subsequent motion, which may cause a deterioration in convergence (response).

In other words, the minimum select is performed in the conventional throttle valve control apparatus, so that the final proportional gain KP and the final integrating gain KI remain unchanged when the absolute opening degree deviation AER is in a larger value range, even if the absolute opening degree deviation AER is changed to a smaller value in the range. Accordingly, the proportional term VP and the integral term VI remain unchanged and also the PI control amount VPI and the duty ratio DUTY remain unchanged. The throttle valve is thus slow in motion as before and therefore the convergence (response) of the subsequent motion could not be improved.

This can be explained based on for example the influence of changes in temperature condition around the engine during operation with respect to the characteristics of the motor which drives the throttle valve. FIG. 13 is a graph showing the magnetic property to temperature of a magnet constituting the motor. FIGS. 14 to 16 are graphs showing the motor torque property at 25° C., at 120° C., and −30° C., respectively. In these graphs of the motor torque property, "T-N" indicates a relation between torque and revolution speed and "T-I" indicates a relation between torque and electric current.

As apparent in the graph in FIG. 13, the magnetic flux density of the magnet is reduced as the temperature rises. Comparing the motor torque property at −30° C. shown in FIG. 16 with that at 25° C. shown in FIG. 14, it is found that electric current and produced torque increase at −30° C. Thus, with respect to the control amount applied to the motor, current and torque increase, enhancing a response. Comparing the motor torque property at 120° C. shown in FIG. 15 with that at 25° C. shown in FIG. 14, on the other hand, it is found that current and produced torque decrease at 120° C. Thus, current and torque decrease with respect to the control amount applied to the motor, deteriorating a response.

The above graphs show that when the temperature of the motor excessively rises, the response of the motor would be deteriorated and therefore the motion of the throttle valve becomes slow. This may affect the convergence (response) in subsequent motion of the throttle valve.

SUMMARY OF THE INVENTION

The present invention has been made in view of the above circumstances and has an object to overcome the above problems and to provide an electronic throttle control apparatus which sets a control gain so that the control gain becomes smaller as a deviation of opening degree between a target opening degree and an actual opening degree becomes larger, and limits a control gain to be set at this time (hereinafter, referred to as "this-time control gain") by a control gain set at a previous time (hereinafter, referred to as "previous control gain") at a time when this-time control gain is larger than the previous control gain, wherein a convergence characteristic (a response) of subsequent motion is allowed to be improved even when a motion of a throttle valve slows down in the process.

To achieve the objects and in accordance with the purpose of the invention, as embodied and broadly described herein, there is provided an electronic throttle control apparatus including: an electronic throttle for drivingly opening and closing a throttle valve by an actuator; target opening degree setting means for setting a target opening degree of the electronic throttle; actual opening degree detection means for detecting an actual opening degree of the electronic throttle; opening degree deviation calculation means for calculating a deviation between the target opening degree and the actual opening degree; control amount calculation means for calculating a control amount of the actuator based on the calculated opening degree deviation and a control gain corresponding to the opening degree deviation; control gain setting means for setting the control gain so that the control gain becomes smaller as the opening degree deviation becomes larger; control gain limitation means for limiting a control gain to be set at this time so as not to change from a control gain set at a previous time when the control gain to be set at this time is larger than the control gain set at a previous time; actuator control means for controlling the actuator based on the calculated control amount; wherein the electronic throttle apparatus including: change speed detection weans for detecting a speed of change of the actual opening degree; and limitation canceling means for canceling the limitation to the control gain by the control gain limitation means when the detected change speed becomes lower than a predetermined value.

In this case, the term "limitation" by the control gain limitation means indicates applying a guard to the control gain, specifically, maintaining a previously set value of the control gain without substituting it with a value of the control gain to be set at this time.

According to the present invention mentioned above, the opening degree deviation between the target opening degree set by the target opening degree setting means and the actual opening degree detected by the actual opening degree detection means is calculated by the opening degree deviation calculation means. The control gain is set by the control gain setting means so that the control gain becomes smaller as the opening degree deviation becomes larger. Then, the control amount is calculated by the control amount calculation means on the basis of the calculated opening degree deviation and the control gain in correspondence to the opening degree deviation, and the actuator is controlled by the actuator control means on the basis of the control amount. Accordingly, in the case that the opening degree deviation is relatively small, the relatively large control gain is set, whereby the relatively large control amount is calculated. Therefore, the actuator is controlled based on the control amount, whereby the actuator quickly starts operating.

In this case, when the opening degree deviation changes to a smaller value, that is, under a condition that the actual opening degree is approaching the target opening degree, the control gain set according to the change intends to change. However, when the control gain to be set at this time is larger than the control gain set at the previous time, the control gain to be set at this time is limited to the control gain set at the previous time, by means of the control gain limitation means, whereby the change of the control amount is limited. Therefore, the actuator is continuously controlled with keeping the initially calculated control amount, and an excess motion of the actuator is inhibited on a process that the opening degree deviation becomes gradually small.

On the contrary, even in the case that the opening degree deviation changes to the smaller value, when the speed of change of the actual opening degree detected by the change speed detection means becomes lower than the predetermined value due to a temporary slowdown motion of the throttle valve in the process, the limit with respect to the change in the limit gain by the control gain limitation means is cancelled by the limit canceling means. Therefore, the actuator is controlled by the control amount calculated on the basis of the control gain corresponding to the opening degree deviation at that time, in place of the initially calculated control amount, and the motion of the actuator in the middle of the motion becomes quick.

Accordingly, in the electronic throttle control apparatus structured such as to set the control gain so that the control gain becomes smaller as the opening degree deviation between the target opening degree and the actual opening degree becomes larger, calculate the control amount of the actuator on the basis of the control gain and the opening degree deviation, and limit the change in the control gain at a time when the opening degree deviation changed to the smaller value, since the limit with respect to the control gain is cancelled at a time when the change speed of the actual opening degree becomes lower than the predetermined value, it is possible to improve a convergence characteristic (a response) of the subsequent motion even when the motion of the throttle valve slows down in the process.

DETAILED DESCRIPTION OF THE PREFERRED EMBODIMENTS

[First Embodiment]

A description will be in detail given below of a first embodiment in which an electronic throttle control apparatus in accordance with the present invention is embodied into a diesel engine for a motor vehicle with reference to the accompanying drawings.

Figure 1:
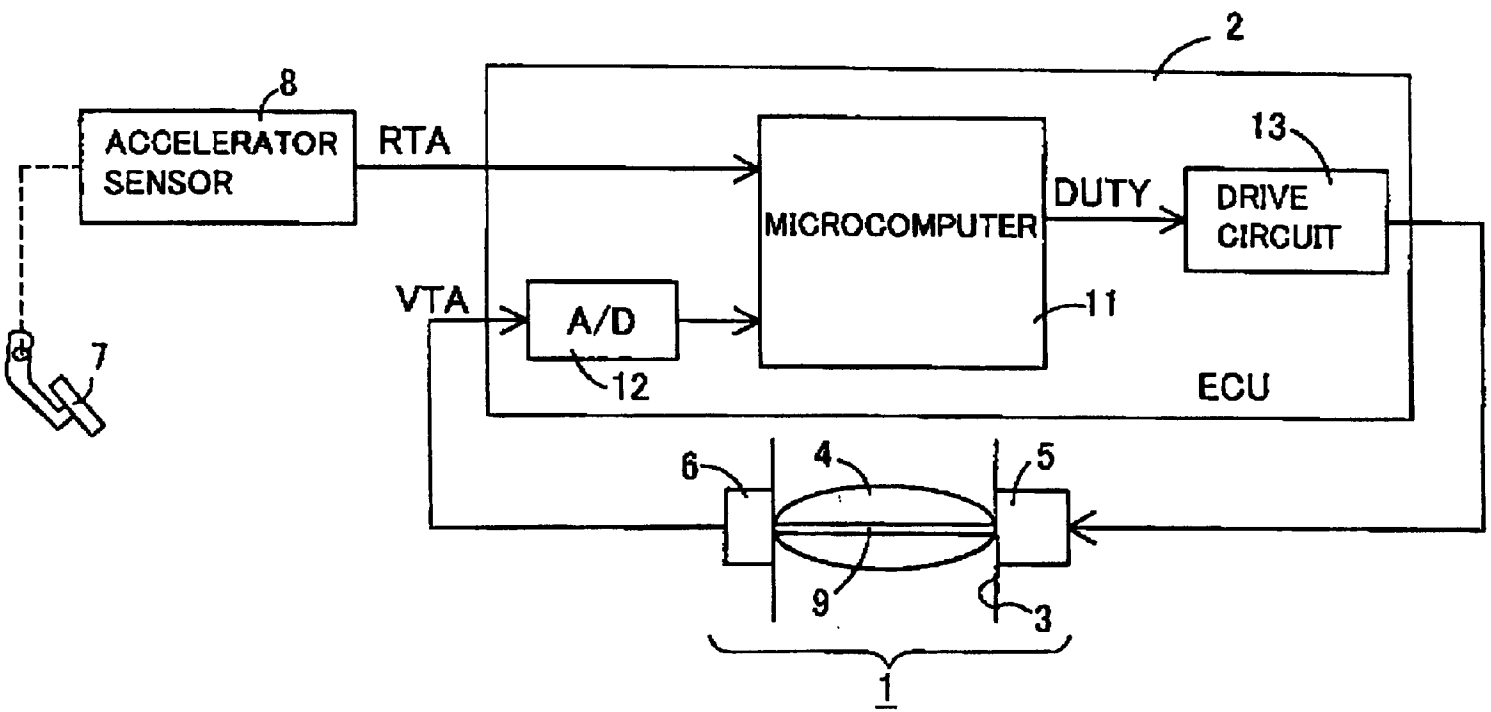
FIG. 1 is a schematic block diagram which shows an electronic throttle control apparatus in a first embodiment.

FIG. 1 shows a schematic block diagram of the electronic throttle control apparatus. The electronic throttle control apparatus is provided with an electronic throttle 1 which is provided in an intake passage of the diesel engine, and an electronic control unit (ECU) 2 for controlling the electronic throttle 1. The electronic throttle 1 is structured such as to drive a motor 5 corresponding to an actuator to open and close a throttle valve 4 provided in a bore 3 of a throttle body constituting the intake passage, and detect an actual opening degree VTA of the throttle valve 4 by means of a throttle sensor 6.

The throttle valve 4 is of a linkless type which does not mechanically work with an operation of an accelerator pedal 7. That is, the throttle valve 4 is driven so as to be opened and closed by the driving force of the motor 5 controlled by the ECU 2 based on an operation amount of the accelerator pedal 7 which is detected by an accelerator sensor 8, an engine rotational speed which is detected by a rotational speed sensor, and the like.

The throttle valve 4 is rotatably supported by a throttle shaft 9 provided so as to extend through the bore 3 of the throttle body. The motor 5 is provided at one end of the throttle shaft 9, and the throttle sensor 6 is provided in the other end thereof. This motor 5 is a torque motor which directly drives the throttle shaft 9 and the throttle valve 4, not through gears. In general, the torque motor tends to have a larger speed of change of the motor as compared with a DC motor which drives the throttle valve through gears, because an inertia of a throttle valve system is light.

The throttle sensor 6 corresponds to actual opening degree detection means and is constructed of for example a potentiometer. The accelerator sensor 8 is provided for the purpose of detecting the operation amount of the accelerator pedal 7 input by a driver as a target opening degree RTA, in order to set a target opening degree RTA of the throttle valve 4, and corresponds to target opening degree setting means. This sensor 8 is constructed of for example a potentiometer.

The electronic throttle control apparatus is used in the diesel engine for the following purpose. First, the electronic throttle control apparatus is used for executing an exhaust gas recirculation (EGR). In this case, in order to make a difference between a back pressure of the engine and an intake pressure as large as possible so as to make it possible to execute a large amount of EGR, an intake air is throttled by the electronic throttle 1. Secondly, the electronic throttle control apparatus is used for a fail safe. In the diesel engine, in the case of sucking oil from an intake system (for example, a PCV system), there is a case that the oil burns and a torque is developed. Then, an intake amount is limited by the electronic throttle 1 in the case that a fuel is not injected in order to prevent the occurrence of abnormal combustion. Thirdly, the apparatus is used to limit the intake amount by the electronic throttle 1 even when an abnormal ascent of rotation and an abnormality in a fuel system are detected. Fourthly, the apparatus is used for a countermeasure against a vibration at a time of stopping the engine. That is, the electronic throttle 1 is fully closed when the engine is stopped, thereby reducing the vibration at an engine stop. At the same time, the electronic throttle 1 is fully closed when an ignition switch is turned off, thereby shutting off the intake air to securely stop the engine.

As shown in FIG. 1, the ECU 2 includes a microcomputer 11, an A/D converter 12 and a drive circuit 13. The microcomputer 11 generally administrates the control of the electronic throttle 1, and corresponds to opening degree deviation calculation means, control amount calculation means, a control gain setting means, control gain limitation means, actuator control means, change speed detection means and limit canceling means. The microcomputer 11 includes a central processing unit (CPU), a random access memory (RAM), a read only memory (RON) and the like, as is well known. A control program for the electronic throttle 1 is stored in the ROM. The A/D converter 12 converts an analog signal output from the throttle sensor 6 into a digital signal so as to output to the microcomputer 11. The drive circuit 13 receives a control electric current corresponding to a control amount output from the microcomputer 11 so as to output a drive electric current to the motor 5.

In FIG. 1, an analog signal relating to the actual opening degree VTA which is output from the throttle sensor 6 is converted into a digital signal by the A/D converter 12. The converted signal is input to the microcomputer 11. An analog signal relating to the target opening degree RTA which is output from the accelerator sensor 8 is directly input to the microcomputer 11.

The microcomputer 11 controls the motor 5 by processing the signals relating to the input actual opening degree VTA and the target opening degree RTA in accordance with a method of PI control. That is, the microcomputer 11 calculates an opening degree deviation ER of the actual opening degree VTA with respect to the target opening degree RTA based on values of various kinds of input signals. The microcomputer 11 calculates a PI control amount VPI in accordance with a predetermined calculating expression based on the calculated opening degree deviation ER. Then, the microcomputer 11 outputs a duty ratio DUTY corresponding to a drive electric current in response to the calculated control amount VPI to the motor 5 through the drive circuit 13, and controls a coil electric current of the motor 5. Accordingly, the microcomputer 11 controls the drive amount of the motor 5 so as to approximate the actual opening degree VTA of the throttle valve 4 to the target opening degree RTA.

Figure 2:
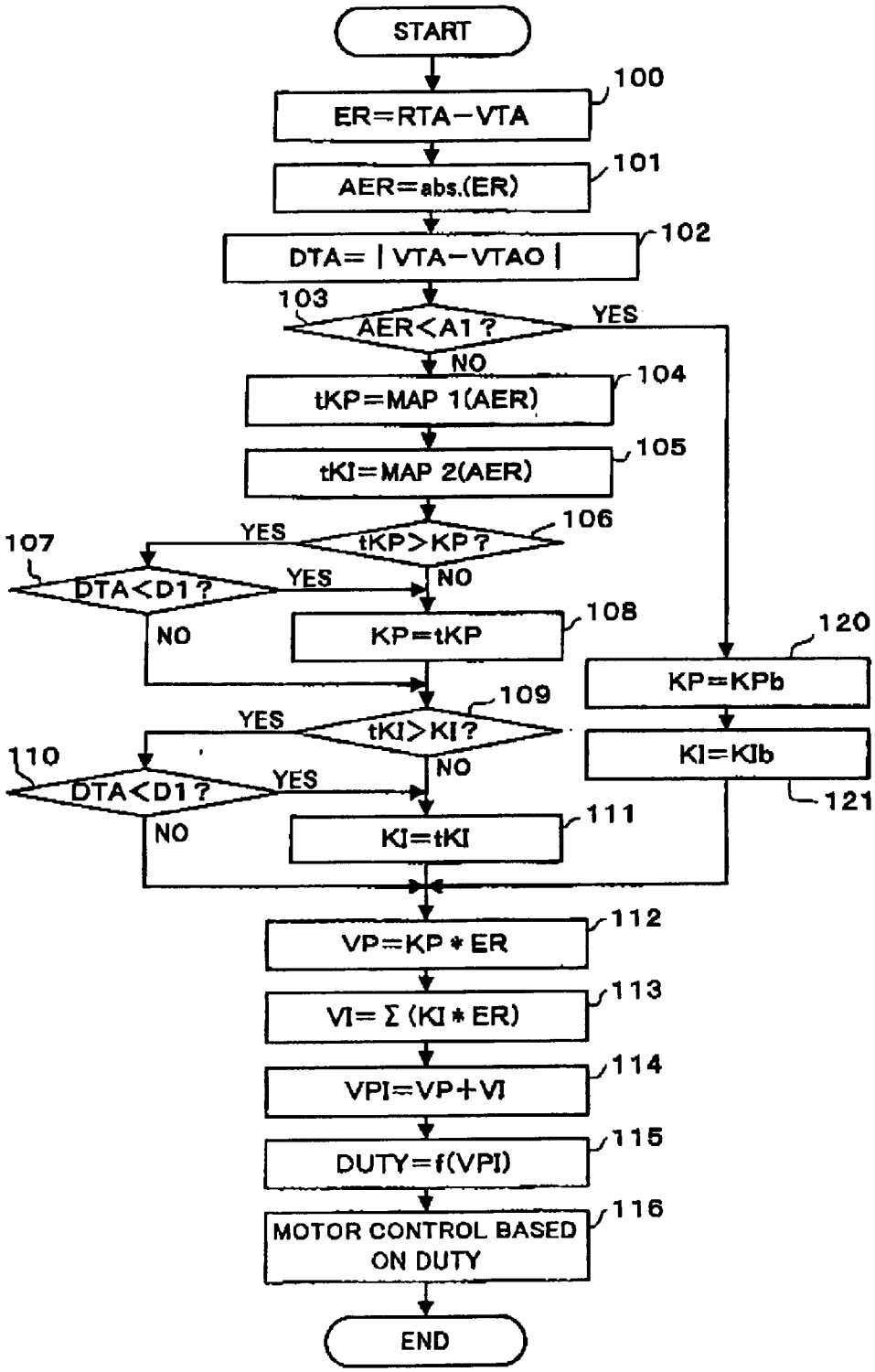
FIG. 2 is a flow chart which shows a throttle control program.

Next, a description will be given of contents of control of the electronic throttle 1. FIG. 2 is a flow chart showing the throttle control program executed by the microcomputer 11. The microcomputer 11 periodically executes this routine at predetermined intervals.

First, in a step 100, the microcomputer 11 calculates a value of an opening degree deviation ER between the target opening degree RTA set by detection of the accelerator sensor 8 and the actual opening degree VTA detected by the throttle sensor 6.

Next, in a step 101, the microcomputer 11 calculates an absolute value (an absolute opening degree deviation) AER of the calculated opening degree deviation ER. The microcomputer 11 executing the processes in the steps 100 and 101 corresponds to opening degree deviation calculation means.

Next, in a step 102, the microcomputer 11 calculates an absolute value (an absolute change speed) DTA of the speed of change of the actual opening degree VTA. The throttle sensor 6 which detects the actual opening degree VTA and the microcomputer 11 which executes the process in this step 102 constitute change speed detection means.

Next, in a step 103, the microcomputer 11 determines whether or not the absolute opening degree deviation AER is smaller than a predetermined value A1. In this case, the predetermined value A1 may employ, for example, a value which can distinguish whether or not the operation change of the throttle valve 4 by the motor 5 enters into a steady state. The microcomputer 11 executing this process corresponds to transitional state judging means. If an affirmative decision is made in this step, it is determined that the throttle opening degree is in a steady state and, in a step 120, the microcomputer 11 sets a gain KPb at the steady time as a final proportional gain KP which is one of the control gains.

In this case, the "steady state" means a state in which the actual opening degree VTA is approximately consistent with the target opening degree RTA. The steady gain KPb corresponds to a value at a time when the absolute opening degree deviation AER of a proportional gain map (map 1) as shown in FIG. 3 becomes 0 (zero).

Next, in a step 121, the microcomputer 11 sets a gain KIb at the steady time as a final integrating gain KI corresponding to one of the control gains, and advances the flow to a step 112. The gain KIb at the steady time corresponds to a value at a time when the absolute opening degree deviation AER of an integrating gain map (map 2) shown in FIG. 4 becomes 0 (zero).

Figure 3:
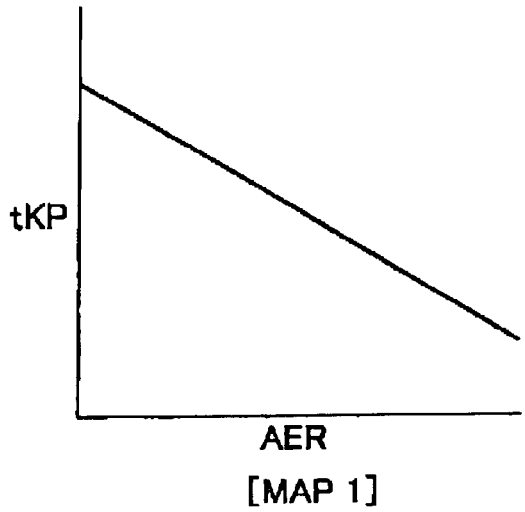
FIG. 3 is a graph which shows a proportional gain map.

On the contrary, if a negative decision is made in the step 103, it is determined that the throttle opening degree is in the transitional state and, in a step 104, the microcomputer 11 calculates a proportional gain tKP which is one of the control gains from the absolute opening degree deviation AER, by referring to the proportional gain map (map 1) shown in FIG. 3. In this case, the proportional gain tKP of the proportional gain map is set so that the proportional gain tKP becomes smaller as the absolute opening degree deviation AER becomes larger. The microcomputer 11 executing this process corresponds to control gain setting means.

Figure 4:
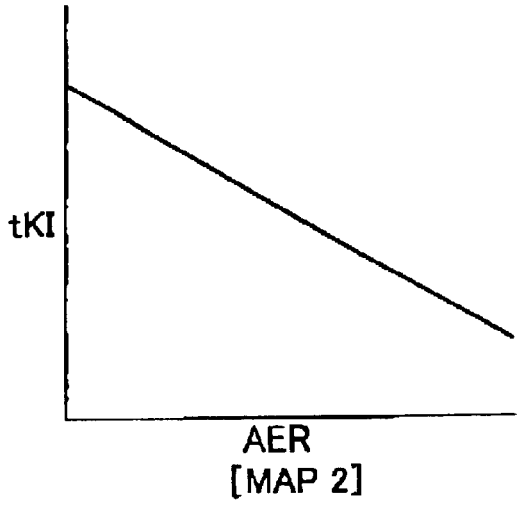
FIG. 4 is a graph which shows an integrating gain map.

In a step 105, the microcomputer 11 calculates an integrating gain tKI from the absolute opening degree deviation AER by referring to the integrating gain map (map 2) as shown in FIG. 4. In this case, the integrating gain tKI of the integrating gain map is set so that the integrating gain tKI becomes smaller as the value of the absolute opening degree deviation AER becomes larger. The microcomputer 11 executing this process corresponds to control gain setting means.

In a step 106, succeedingly, the microcomputer 11 determines whether or not the proportional gain tKP calculated at this time is larger than the final proportional gain KP used at a previous time. If a negative decision is made, the microcomputer 11 updates the final proportional gain KP by the proportional gain tKP calculated at this time in a step 108, and advanced the flow to a step 109. More specifically, in this case, this-time absolute opening degree deviation AER is larger than the previous absolute opening degree deviation AER, so that the proportional gain tKP smaller than the previous final proportional gain KP is selected as this-time final proportional gain KP. The "minimum select" is thus executed. If an affirmative decision is made in the step 106, the microcomputer 11 advances the process to a step 107.

In the step 107, the microcomputer 11 determines whether or not the absolute change speed DTA calculated at this time is smaller than a predetermined value D1. In this case, the predetermined value D1 may be, for example, a value approximate to "0". The predetermined value D1 is applied to a value capable of detecting that the motion change of the throttle valve 4 slows down in comparison with the normal motion_change. If a negative decision is made in the step 107, the microcomputer 11 determines that the motion change of the throttle valve 4 is comparatively large and advances the flow directly to the step 109. In this case, since this-time absolute opening degree deviation AER is not larger than the previous absolute opening degree deviation AER, the microcomputer 11 does not update this-time final proportional gain KP by the proportional gain tKP larger than the previous final proportional gain KP. The microcomputer 11 limits the change in the final proportional gain KP in the manner mentioned above.

On the contrary, if an affirmative result is obtained in the step 107, the microcomputer 11 determines that the change speed of the throttle valve 4 is comparatively low and in the step 108 updates the final proportional gain KP by the value of proportional gain tKP calculated at this time, and advances the flow to the step 109. Specifically, in this case, on the assumption that the absolute opening degree deviation AER set at this time is not larger than the absolute opening degree deviation AER set at a previous time, however, the motion change of the throttle valve 4 slows down in comparison with the original motion change for some reasons, the microcomputer 11 updates this-time final proportional gain KP by the value of the proportional gain tKP larger than the previous final proportional gain KP. More specifically, the microcomputer 11 cancels the limit in change of the final proportional gain KP. In other words, the microcomputer 11 cancels the "minimum select" of the final proportional gain KP.

In this embodiment, the microcomputer 11 executing the processes included in the steps 106 to 108 corresponds to control gain limitation means. Further, the microcomputer 11 executing the processes in the steps 107 and 108 corresponds to limit canceling means.

Thereafter, in the step 109 following the step 107 or 108, the microcomputer 11 determines whether or not the integrating gain tKI calculated at this time is larger than the final integrating gain KI used at a previous time. If a negative decision is made, the microcomputer 11 updates the final integrating gain KI by the value of the integrating gain tKI calculated at this time in a step 111, and advances the flow to a step 112. That is, in this case, since this-time absolute opening degree deviation AER is larger than the previous absolute opening degree deviation AER, the microcomputer 11 selects the integrating gain tKI smaller than the previous final integrating gain KI as this-time final proportional gain KI, and executes the "minimum select". If an affirmative decision is made in the step 109, the microcomputer 11 advances the flow to a step 110.

In the step 110, the microcomputer 11 determines whether or not the absolute change speed DTA calculated at this time is smaller than the predetermined valve D1. If a negative result is obtained, the microcomputer 11 determines that the motion change of the throttle valve 4 is comparatively large and shifts the process directly to the step 112. Specifically, in this case, since this-time absolute opening degree deviation AER is not larger than the previous absolute opening degree deviation AER, the microcomputer 11 does not updates this-time final integrating gain KI by the value of the integrating gain tKI larger than the previous final integrating gain KI. As mentioned above, the microcomputer 11 limits the change in the final integrating gain KI.

On the contrary, if an affirmative result is obtained in the step 110, the microcomputer 11 determines that the change speed of the throttle valve 4 is comparatively small and, in the step 111, updates the final proportional gain KI by the value of the integrating gain tKI calculated at this time, and advances the process to the step 112. In this case, on the assumption that this-time absolute opening degree deviation AER is not larger than the previous absolute opening degree deviation AER, however, the motion change of the throttle valve 4 slows down in comparison with the original motion change for some reasons, the microcomputer 11 updates this-time final integrating gain KI by the value of the integrating gain tKI which is larger than the value of the previous final integrating gain KI. That is, the microcomputer 11 cancels the limit in the change of the final integrating gain KI. In other words, the microcomputer 11 cancels the "minimum select" of the final integrating gain KI.

In this embodiment, the microcomputer 11 executing the processes included in the steps 109 to 111 corresponds to the control gain limitation means. Further, the microcomputer 11 executing the processes in the steps 110 and 111 corresponds to the limit canceling means.

Thereafter, in the step 112 following the step 110, 111, or 121, the microcomputer 11 calculates a proportional term VP by multiplying this-time final proportional gain KP by this-time opening degree deviation ER.

Next, in a step 113, the microcomputer 11 calculates an integrating term VI by adding a product of this-time final integrating gain KI and this-time opening degree deviation ER to the result of previous addition.

Next, in a step 114, the microcomputer 11 calculates a PI control amount VPI by adding the proportional term VP calculated at this time to the integrating term VI. In this embodiment, the microcomputer 11 executing the processes in the steps 112 to 114 corresponds to control amount calculation means.

Next, in a step 115, the microcomputer 11 converts the PI control amount VPI calculated at this time into a duty ratio DUTY in accordance with a predetermined function expression.

Then, in a step 116, the microcomputer 11 controls the motor 5 based on the converted duty ratio DUTY to drivingly open and close the throttle valve 4. In this embodiment, the microcomputer 11 executing the processes in the steps 115 and 116 corresponds to actuator control means.

Figure 5:
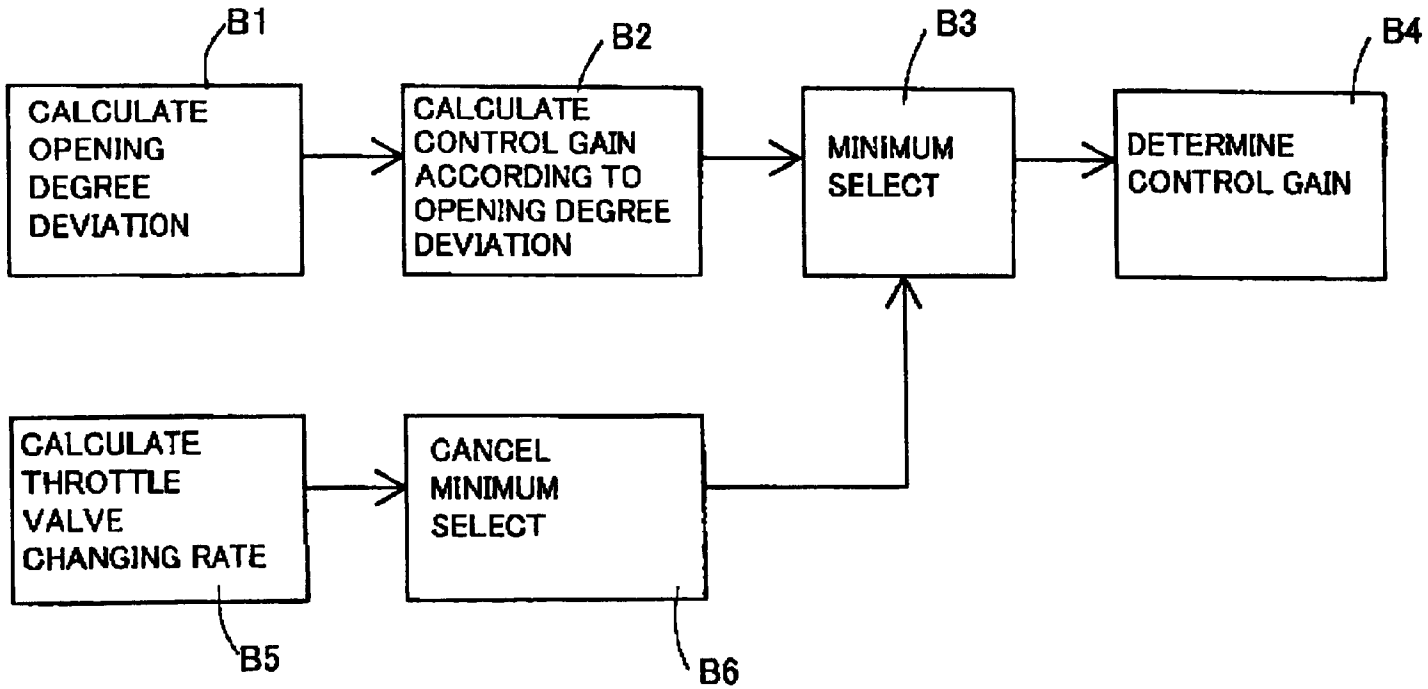
FIG. 5 is a block diagram which shows a feature of a throttle control program.

The characteristic of the routine mentioned above exists in determining the final proportional gain KP and the final integrating gain KI by the "minimum select", and canceling the "minimum select" in the case that the motion of the throttle valve 4 slows down during motion. This can be shown by a block diagram in FIG. 5. First, in a block B1, the microcomputer 11 calculates the opening degree deviation between the target opening degree and the actual opening degree. Next, in a block B2, the microcomputer 11 calculates the control gain in correspondence to the opening degree deviation. Next, in a block B3, the microcomputer 11 executes the "minimum select" to select the smaller control gain of the calculated control gains. Then, in a block B4, the microcomputer 11 determines the control gain obtained by the "minimum select" as the final control gain. In this case, as well as in the block B1, the microcomputer 11 calculates the opening degree deviation, the microcomputer 11 calculates the change speed of the throttle valve, that is, the change speed of the actual opening degree VTA, in a block B5. If the change speed is relatively low, the microcomputer 11 cancels the "minimum select" of the block B3 in a block B6.

In other words, the electronic throttle control apparatus in this embodiment is provided with the proportional gain tKP and the integrating gain tKI in correspondence to the absolute opening degree deviation AER in the map. However, when the absolute opening degree deviation AER changes to a larger value according to the motion of the throttle valve 4, the apparatus updates the final proportional gain KP and the final integrating gain KI to the value in the smaller value. When the absolute opening degree deviation AER changes to the smaller value, on the contrary, the apparatus does not update the final proportional gain KP and the final integrating gain KI. Specifically, the apparatus executes the "minimum select". In this electronic throttle control apparatus, furthermore, when the motion of the throttle valve 4 slows down during motion, the minimum selects is canceled even under the condition of executing the "minimum select" mentioned above. The values of the final proportional gain KP and the final integrating gain KI appropriate for the absolute opening degree deviation AER at that time are determined.

As described above, according to the electronic throttle control apparatus in this embodiment, the opening degree deviation ER and the absolute opening degree deviation AER are respectively calculated by the microcomputer 11 based on the target opening degree RTA which is set by detection of the accelerator sensor 8 and the actual opening degree VTA which is detected by the throttle sensor 6. Then, the PI control amount VPI is calculated by the microcomputer 11 so that the PI control amount VPI becomes smaller as the absolute opening degree deviation AER becomes larger. In more detail, the proportional gain tKP and the integrating gain tKI which become smaller as the absolute opening degree deviation AER becomes larger are respectively set by the microcomputer 11. The PI control amount VPI is calculated by the microcomputer 11 based on the opening degree deviation ER, and the proportional gain tKP and the integrating gain tKI in correspondence to the opening degree deviation ER. Further, the motor 5 is controlled by the microcomputer 11 based on the duty ratio DUTY which is converted from the PI control amount VPI.

Accordingly, in the case that the value of the absolute opening degree deviation AER is relatively small, the motor 5 is controlled based on the relatively large PI control amount VPI, and the motor 5 quickly starts operating. In detail, when the absolute opening degree deviation AER is relatively small, the proportional gain tKP and the integrating gain tKI which are relatively large are set as the final proportional gain KP and the final integrating gain KI. Accordingly, the relatively large PI control amount VPI is calculated, and the motor 5 is controlled based on the PI control amount VPI, whereby the motor 5 quickly starts operating. Therefore, for example, in the case that the beginning absolute opening degree deviation AER is relatively small during a transitional operation where the target opening degree RTA is temporarily increased, it is possible to quickly open the throttle valve 4 and therefore increase a response as the electronic throttle 1.

In the present embodiment, during the transitional operation, in the process that the absolute opening degree deviation AER changed to the smaller value, that is, under the condition that the actual opening degree VTA approaches the target opening degree RTA, the change in the PI control amount VPI which in calculated in correspondence with the change is limited by the microcomputer 11. In more detail, the proportional gain tKP and the integrating gain tKI which are set according to the absolute opening degree deviation AER are respectively going to change. However, since the proportional gain tKP and the integrating gain tKI which are set at this time are larger than the final proportional gain KP and the final integrating gain KI which are set at the previous time, the proportional gain tKP and the integrating gain tKI which are set at this time are limited by the final proportional gain KP and the final integrating gain KI which are set at the previous time. More specifically, the final proportional gain KP and the final integrating gain KI are not respectively updated, but are kept at the previous values. Then, since the final proportional gain KP and the final integrating gain KI are not updated, the change in the PI control amount VPI can be limited.

Accordingly, the motor 5 is continuously controlled based on the PI control amount VPI as calculated at the beginning of the transitional operation. The excess motion of the motor 5 can be limited in the process that the absolute opening degree deviation AER becomes gradually smaller. Therefore, even when the first absolute opening degree deviation AER is comparatively large during the transitional operation, it is possible to prevent the throttle valve 4 from opening over the target opening degree RTA, that is, from overshooting. It is therefore possible to improve a convergence characteristic of the throttle valve 4.

Figure 6:
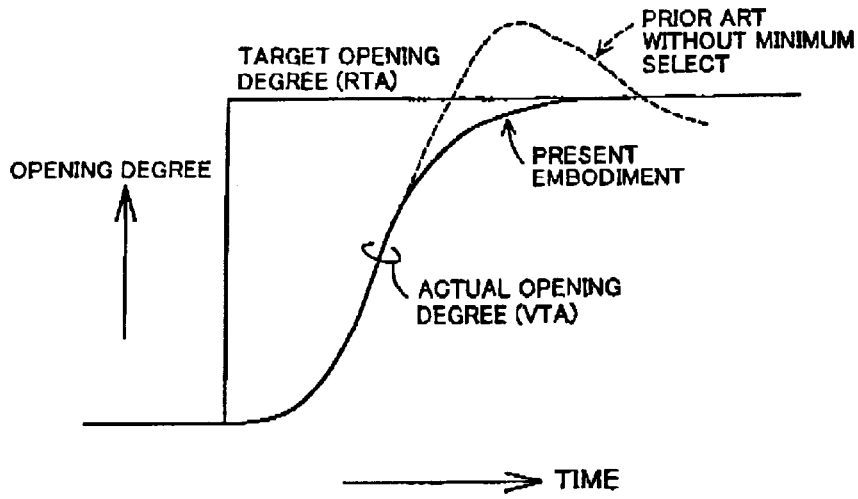
FIG. 6 is a time chart which shows a standard response waveform of an actual opening degree.

This matter can be shown by a graph in FIG. 6. FIG. 6 shows a standard response waveform of the actual opening degree VTA. As is apparent from FIG. 6, in the present embodiment wherein the "minimum select" is performed, it is found that the response waveform which is excellent in the response and the convergence characteristic can be obtained as shown by the solid curve. On the contrary, in the prior art wherein the "minimum select" is not executed, the overshoot occurs as shown by a broken line.

On the contrary, even in the process that the absolute opening degree deviation AER changes to the smaller value during the transitional operation, that is, even under the condition that the actual opening degree VTA approaches the target opening degree RTA, when the absolute change speed DTA of the actual opening degree VTA becomes lower than the predetermined value A1 due to the temporary slowdown or the temporary stop of the motion of the throttle valve 4 during motion, the limit with respect to the change in the PI control amount VPI mentioned above is reduced by the microcomputer 11. In more detail, the limit with respect to the change in the final proportional gain KP and the final integrating gain KI mentioned above is canceled by the microcomputer 11, whereby the limit with respect to the change in the PI control amount VPI is canceled.

In other words, the electronic throttle control apparatus in this embodiment is structured such that the control gain (the final proportional gain KP and the final integrating gain KI) in correspondence to the absolute opening degree deviation AER is scheduled in accordance with a rule (minimum select) that the control gain is not switched to the smaller value in the deviation AER even if the absolute opening degree deviation AER is reduced. When the motion speed of the throttle valve 4 becomes slower than the predetermined value, the switching of the control gain is permitted according to the absolute opening degree deviation AER at that time.

Accordingly, the PI control amount VPI can be calculated based on the final proportional gain KP and the final integrating gain KI appropriate for the absolute opening degree deviation AER at that time, in place of the first calculated PI control amount VPI. Then, the motor 5 is controlled based on the calculated PI control amount VPI to quickly operate. Therefore, even under the condition that the motion of the throttle valve 4 temporarily slows down during motion or temporarily stops, for example, due to dispersion in products or a change with age, or a change in temperature condition during the operation or the like, it is possible to improve the convergence characteristic (response) of the thereafter motion of the throttle valve 4. In this embodiment, particularly, the torque motor having the high speed change is used and it is therefore possible to obtain a significant effect with respect to the motion convergence characteristic (response) mentioned above.

Figure 7:
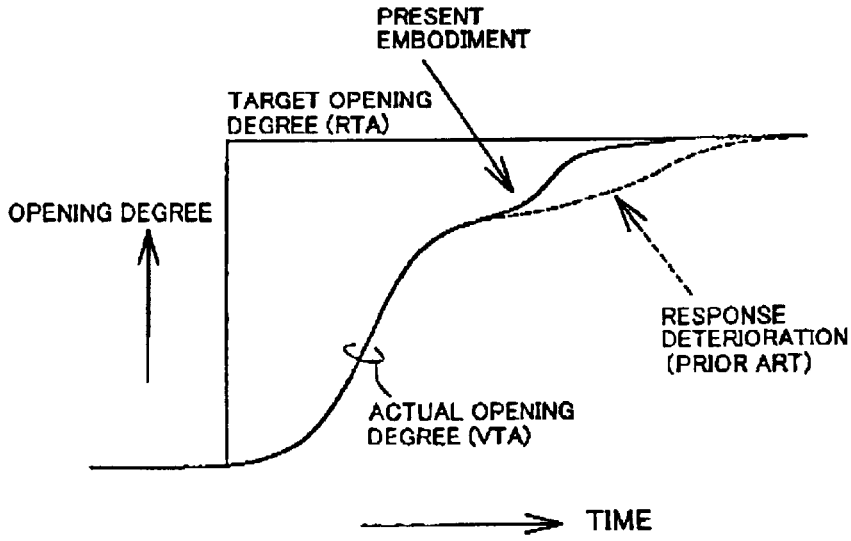
FIG. 7 is a time chart which shows a response waveform of an actual opening degree at a time when a motion of an electronic throttle slows down.

This can be shown by a graph in FIG. 7. FIG. 7 shows a response waveform of the actual opening degree VTA at a time when the motion of the electronic throttle 1 slows down due to the change with age, the change in temperature condition or the like. As is apparent from FIG. 7, in the prior art where the "minimum select" is executed, the response is deteriorated as shown by a broken line even if the motion temporarily slows down during motion. On the contrary, in the present embodiment, the "minimum select" is temporarily cancelled when the motion temporarily slows down during motion, which can improve the response as shown by a solid curve.

[Second Embodiment]

Next, a description will be given in detail of a second embodiment in which the electronic throttle control apparatus in accordance with the present invention is embodied in a diesel engine for a motor vehicle with reference to the accompanying drawings. In this embodiment, the same reference numerals are attached to the same structures as those in the first embodiment, and a description thereof will be omitted. A description mainly given below will be of different points.

In this embodiment, the structure is different from the first embodiment in view of the contents of the throttle control program. In this embodiment, it is intended to achieve the control in line with actual conditions according to the torque characteristic of the motor 5 which is a torque motor, by adding a feed-forward term VF to the throttle control. Furthermore, it is intended to achieve the control in line with the actual conditions by employing a differential preceding PI control.

Figure 8:
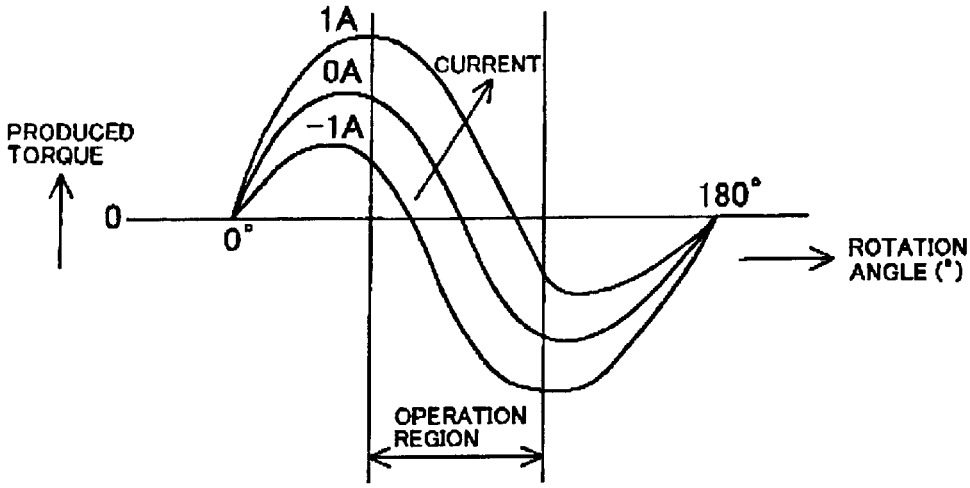
FIG. 8 is a graph which shows a torque characteristic of a torque motor in a second embodiment.

FIG. 8 is a graph showing a torque characteristic of the motor 5. In this graph, a produced torque in a vertical axis indicates a torque in an open side of the throttle valve 4 by a direction of an arrow. In accordance with this characteristic, it is found that the throttle valve 4 stands still at "the produced torque=0 (zero)", the throttle valve 4 is driven in the open direction at "the produced torque >0", the throttle valve 4 is driven in a close direction at "the produced torque <0", and the opening degree at which "produced torque=0" is achieved changes by different electric currents (1A, 0A, −1A).

The application of a predetermined electric current to the motor 5 causes the throttle valve 4 to maintain a predetermined opening degree. Accordingly, it is possible to increase a control characteristic (response) as the electronic throttle 1 by previously applying an electric current according to a desired target opening degree RTA to the motor 5.

In this embodiment, in order to previously add the electric current (the "duty ratio DUTY" on the control) according to the desired target opening degree RTA to the control amount, a feed-forward term VF is added to the parameters in the throttle control. Further, in order to achieve the differential preceding PI control, a differential process is added to calculation of the opening degree deviation ER to be used for the feedback control. The contents of the throttle control are described below.

Figure 9:
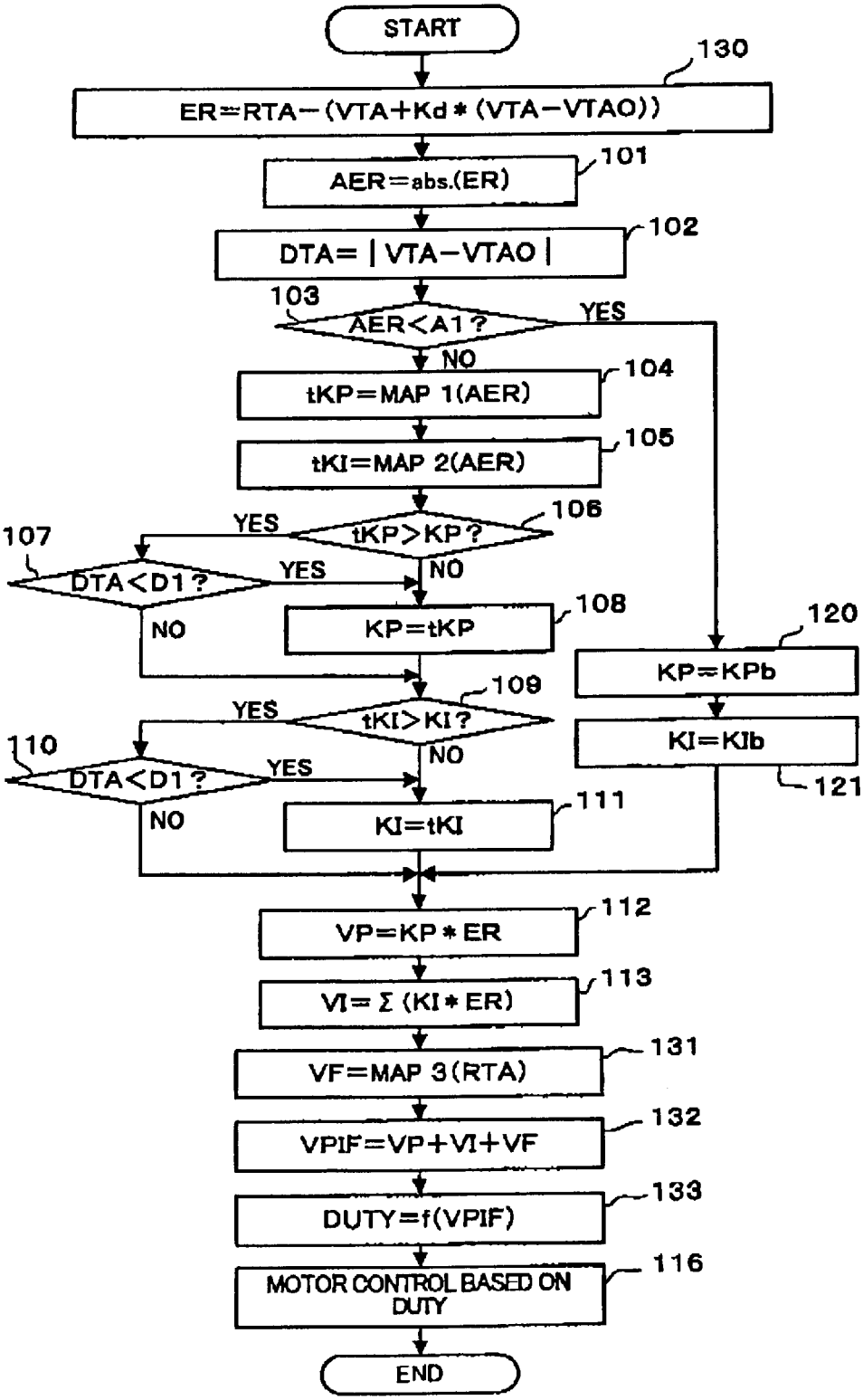
FIG. 9 is a flow chart which shows a throttle control program.

FIG. 9 is a flow chart showing a throttle control program to be executed by the microcomputer 11. In this flow chart, steps 101 to 113, 116, 120 and 121 show the same process contents as those of the steps 101 to 113, 116, 120 and 121 of the flow chart in FIG. 2, and steps 130 to 133 show different process contents from the flow chart in FIG. 2. The microcomputer 11 periodically executes this routine at predetermined intervals.

First, in a step 130, the microcomputer 11 adds an actual opening degree VTA to a value obtained by multiplying a differential value (VTA−VTAO) of the actual opening degree VTA detected by the throttle sensor 6 by a differential gain Kd, and further calculates the opening degree deviation ER with respect to the target opening degree RTA set by the detection of the accelerator sensor 8. In this case, the term "VTAO" means the previous detected actual opening degree. As mentioned above, the differential preceding PI control is achieved by adding the differential process to the calculation of the opening degree deviation ER which is used for the feedback control.

The microcomputer 11 then advances the flow from the steps 130 to 101, and sequentially executes the processes in the steps 101 to 113, 120, and 121 in the same manner as that of the flow chart in FIG. 2.

Figure 10:
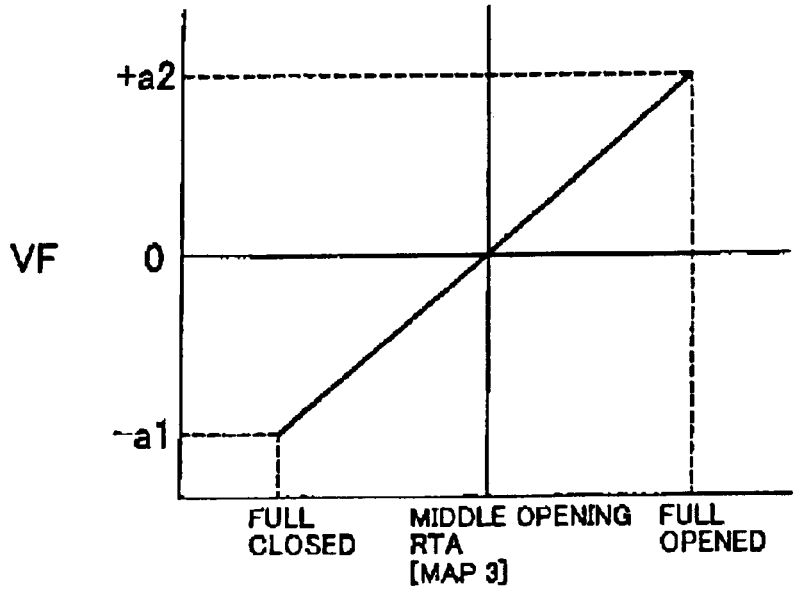
FIG. 10 is a graph which shows a feed-forward term map.
Figure 11:
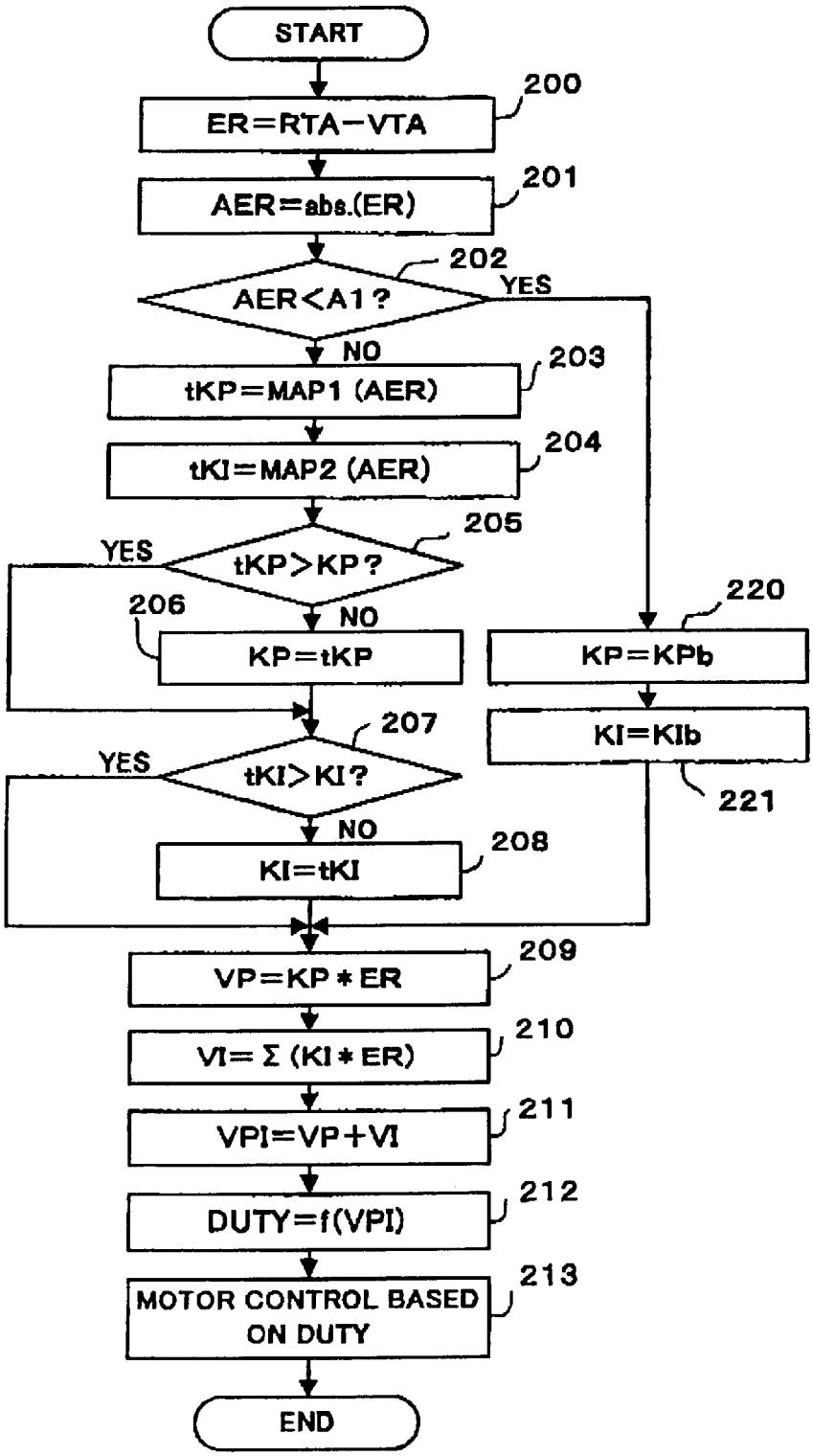
FIG. 11 PRIOR ART
FIG. 11 is a flow chart which shows a throttle control program in the prior art.
Figure 12:
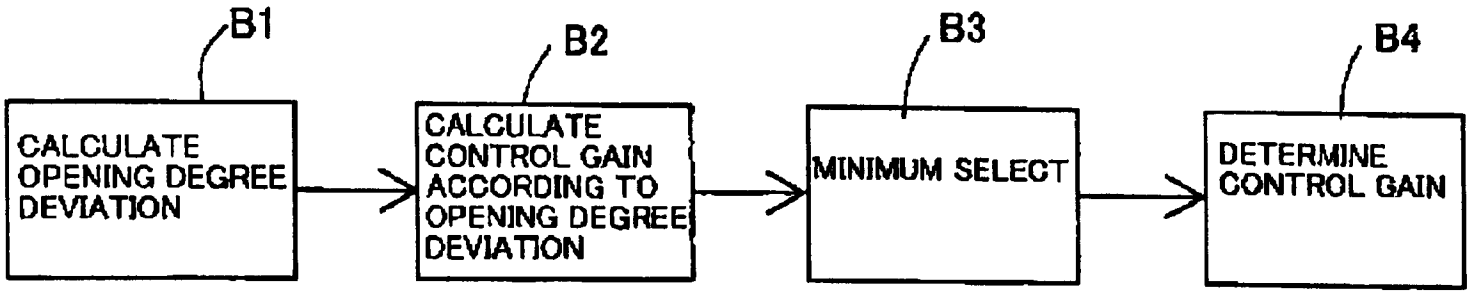
FIG. 12 PRIOR ART
FIG. 12 is a block diagram which shows a throttle control program in the prior art.
Figure 13:
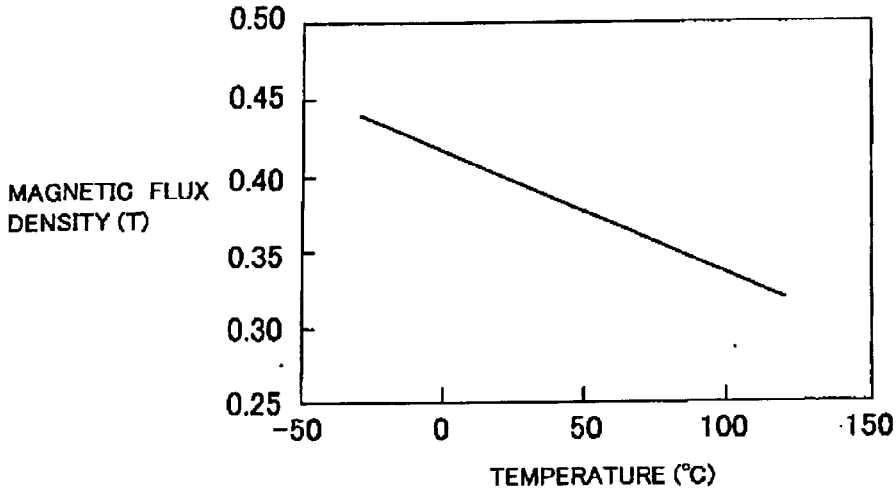
FIG. 13 is a graph which shows a magnetic characteristic of a motor magnet according to a temperature.
Figure 14:
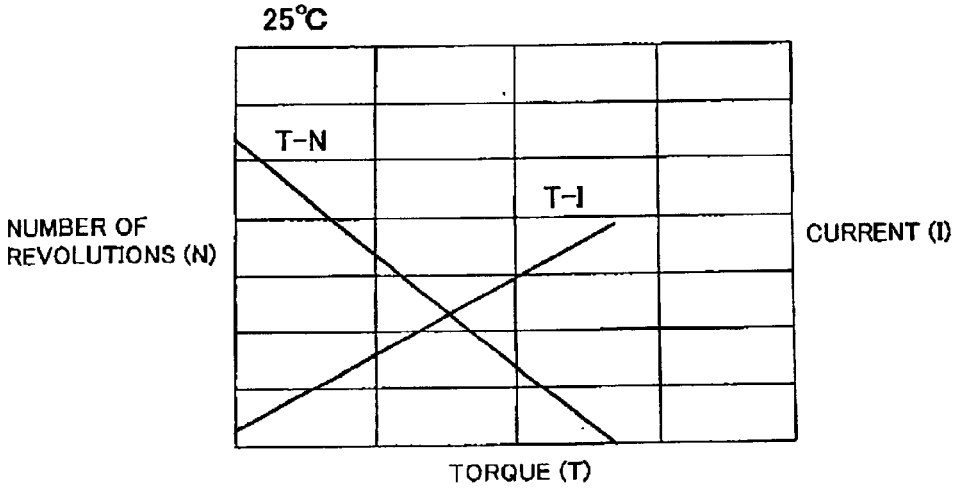
FIG. 14 is a graph which shows a motor torque characteristic at 25° C.
Figure 15:
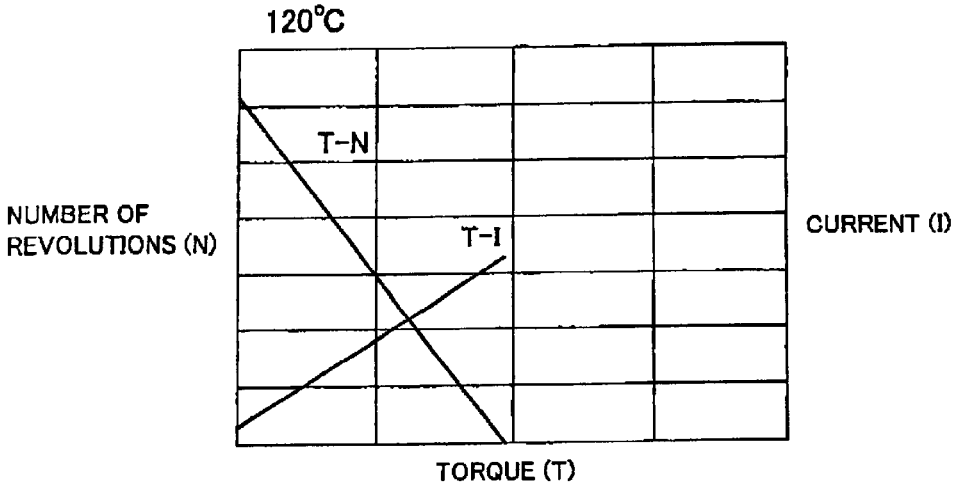
FIG. 15 is a graph which shows a motor torque characteristic at 120° C.
Figure 16:
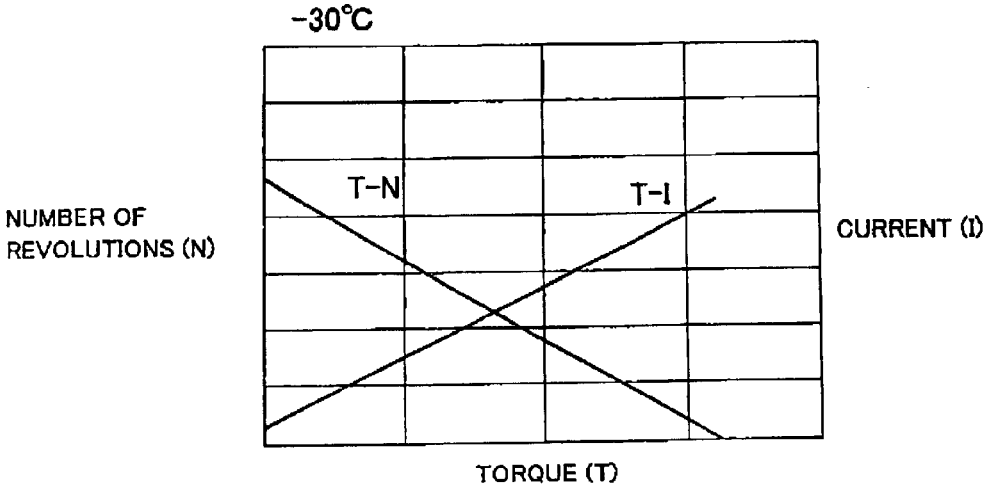
FIG. 16 is a graph which shows a motor torque characteristic at −30° C.

In a step 131 following the step 113, the microcomputer 11 calculates the feed-forward term VR from the target opening degree RTA by referring to a feed-forward term map (map 3) as shown in FIG. 10. In this feed-forward term map, it is set so that the feed-forward term VF becomes "0" when the target opening degree RTA becomes a middle opening degree, the feed-forward term VF becomes larger toward a positive predetermined value "+a2" as the target opening degree RTA becomes larger to a full-open direction from the middle opening degree, and the feed-forward term VF becomes smaller toward a negative predetermined value "−a1" as the target opening degree RTA becomes smaller to a full-close direction from the middle opening degree. The microcomputer 11 executing this process corresponds to feed-forward term setting means.

In a step 132, the microcomputer 11 calculates a PIF control amount VPIF by adding this-time calculated proportional term VP, the integrating term VI, and the feed-forward term VF. In this embodiment, the microcomputer 11 executing the steps 112, 113, 131, and 132 corresponds to control amount calculation means.

In a step 133, the microcomputer 11 converts this-time calculated PIF control amount VPIF into the duty ratio DUTY in accordance with a predetermined function expression.

In the step 116, the microcomputer 11 drives the motor 5 based on the converted duty ratio DUTY to drivingly open and close the throttle valve 4. In this embodiment, the microcomputer 11 executing the processes in the steps 133 and 116 corresponds to actuator control means.

The contents of the throttle control program in the present embodiment are as above. Accordingly, the electronic throttle control apparatus in this embodiment can provide the same operations and effects as those in the first embodiment. More specifically, the PIF control amount VPIF can be calculated based on the final proportional gain KP, the final integrating KI, and the feed-forward term VF each appropriate for the absolute opening degree deviation AER at that time, in place of the first calculated PIF control amount VPIF. The motor 5 is then controlled based on the calculated PIF control amount VPIF to quickly operate. Accordingly, even under the condition that the motion of the throttle valve 4 temporarily slows down during motion or temporarily stops due to the dispersion of products or the change with age in the products, or the change in temperature condition during the operation or the like, it is possible to improve the convergence characteristic (response) of the subsequent motion in the throttle valve 4.

In this embodiment, additionally, the PIF control amount VPIF obtained by adding the feed-forward term VF is calculated, and the motor 5 is controlled based on the control amount VPIF. Accordingly, it is possible to previously apply the electric current to the motor 5 by an amount of the feed-forward term VF corresponding to the desired target opening degree RTA. It is also possible to more enhance the controllability (response) as the electronic throttle 1 as compared with that in the first embodiment.

In this case, the characteristic of the motor 5 fluctuates due to the change in temperature condition, so that the previously given value of the feed-forward term VF does not meet with the actual value. A little control error is thus added at that degree, which may cause nonuniform motion of the electronic throttle 1. Similar control error is also added due to variations in torque characteristic due to product variance, which may cause nonuniform motion of the electronic throttle 1. However, in the electronic throttle control apparatus of which the controllability (response) is improved by adding the feed-forward term VF, as in this embodiment, a phenomenon that the response slows down temporarily due to the product variance, the change in temperature condition or the like is easily generated, whereas there exists the effect capable of compensating such defective phenomenon. Thus, it can be said that the electronic throttle control apparatus is more preferable.

In this embodiment, furthermore, the throttle control is set to the differential preceding PI control, so that sign of the opening degree deviation ER reverses when the actual opening degree VTA approaches the target opening degree RTA. It is therefore possible to apply the electric current in a reverse direction to the motor 5, thereby applying a braking effect to the motor 5. Accordingly, it is possible to brake the motor 5 under operation at a high speed, thereby enhancing a response as the electronic throttle 1. As a result, containing the elements which cause variations in operation according to an applied degree of brake due to product-to-product variation and a change in temperature (and also due to a change in friction by temperature), the electronic throttle 1 has the phenomenon that the response temporarily slows down. However, the electronic throttle control apparatus in the present embodiment can compensate such defective conditions and therefore it is considered more preferable.

In this case, this invention is not limited to the respective embodiments mentioned above, and may be carried out as follows by suitably modifying a part of the structure within a range of the scope of the invention.

In the first embodiment mentioned above, the final proportional gain KP and the final integrating gain KI which are calculated in correspondence to the absolute opening degree deviation AER are used as the control gain to calculate the PI control amount VPI corresponding to the control amount. Alternatively, the proportional gain, the integrating gain, and the differential gain may be used as the control gain to calculate the PID control amount corresponding to the control amount.

In each embodiment mentioned above, the motor 5 constituted by the torque motor is used as the actuator, however, a DC motor may be used in place of the torque motor.

In each embodiment mentioned above, the electronic throttle control apparatus is applied to a diesel engine for a motor vehicle. Alternatively, the apparatus may be applied to a gasoline engine for a motor vehicle. In this case, the electronic throttle control apparatus is used for adjustment of power of the gasoline engine.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. An electronic throttle control apparatus including:

an electronic throttle for drivingly opening and closing a throttle valve by an actuator;

target opening degree setting means for setting a target opening degree of the electronic throttle;

actual opening degree detection means for detecting an actual opening degree of the electronic throttle;

opening degree deviation calculation means for calculating a deviation between the target opening degree and the actual opening degree;

control amount calculation means for calculating a control amount of the actuator based on the calculated opening degree deviation and a control gain corresponding to the opening degree deviation;

control gain setting means for setting the control gain so that the control gain becomes smaller as the opening degree deviation becomes larger;

control gain limitation means for limiting a control gain to be set at this time so as not to change from a control gain set at a previous time when the control gain to be set at this time is larger than the control gain set at a previous time;

actuator control means for controlling the actuator based on the calculated control amount;

wherein the electronic throttle apparatus including:

change speed detection means for detecting a speed of change of the actual opening degree; and limitation canceling means for canceling the limitation to the control gain by the control gain limitation means when the detected change speed becomes lower than a predetermined value.

2. The electronic throttle control apparatus according to claim 1, wherein the control amount is a PI control amount to be calculated by addition of a proportional term and an integral term;

the actuator control means converts the PI control amount to a duty ratio by a predetermined function expression to control the actuator;

the control gain includes a proportional gain and an integrating gain each being calculated according to the opening degree deviation; and the control amount calculation means calculates the proportional term by multiplying the proportional gain by the opening degree deviation and calculates the integral term by accumulating the product of the integrating gain and the opening degree deviation.

3. The electronic control apparatus according to clam 2, wherein the control gain setting means sets the proportional gain to a predetermined gain for a steady operation when the opening degree deviation is in a steady state where the deviation is smaller than a predetermined value, and calculates the proportional gain according to the opening degree deviation by referring to a predetermined proportional gain map when the opening degree deviation is in a transitional state where the deviation is equal to or larger than the predetermined value, the proportional gain map being set constructed so that the proportional gain becomes smaller as the opening degree deviation becomes larger, and the control gain setting means sets the integrating gain to the gain for the steady operation when the opening degree deviation is in the steady state where it is smaller than a predetermined value, and calculates the integrating gain according to the opening degree deviation by referring to a predetermined integrating gain map when the opening degree deviation is in the transitional state where the deviation is equal to or larger than the predetermined value, the integrating gain map being set so that the integrating gain becomes smaller as the opening degree deviation becomes larger.

4. The electronic throttle control apparatus according to claim 1, wherein the throttle valve is rotatably supported in a bore of a throttle body providing an intake passage of an engine, by a throttle shaft inserted through the bore, the actuator is a torque motor which directly operates the throttle shaft and the throttle valve without using a gear, the target opening degree setting means is an accelerator sensor for detecting an operation amount of an accelerator pedal by a driver as the target opening degree, the actual opening degree detection means is a throttle sensor for detecting an actual opening degree of the throttle valve, and the opening degree deviation calculation means, the control amount calculation means, the control gain setting means, the control gain limitation means, the actuator control means, the change speed detection means, and the limitation canceling means are constructed of a single electronic control unit which includes a microcomputer, an A/D converter, and a drive circuit.

5. The electronic throttle control apparatus according to claim 2, wherein the throttle valve is rotatably supported in a bore of a throttle body providing an intake passage of an engine, by a throttle shaft inserted through the bore, the actuator is a torque motor which directly operates the throttle shaft and the throttle valve without using a gear, the target opening degree setting means is an accelerator sensor for detecting an operation amount of an accelerator pedal by a driver as the target opening degree, the actual opening degree detection means is a throttle sensor for detecting an actual opening degree of the throttle valve, and the opening degree deviation calculation means, the control amount calculation means, the control gain setting means, the control gain limitation means, the actuator control means, the change speed detection means, and the limitation canceling means are constructed of a single electronic control unit which includes a microcomputer, an A/D converter, and a drive circuit.

6. The electronic throttle control apparatus according to claim 3, wherein the throttle valve is rotatably supported in a bore of a throttle body providing an intake passage of an engine, by a throttle shaft inserted through the bore, the actuator is a torque motor which directly operates the throttle shaft and the throttle valve without using a gear, the target opening degree setting means is an accelerator sensor for detecting an operation amount of an accelerator pedal by a driver as the target opening degree, the actual opening degree detection means is a throttle sensor for detecting an actual opening degree of the throttle valve, and the opening degree deviation calculation means, the control amount calculation means, the control gain setting means, the control gain limitation means, the actuator control means, the change speed detection means, and the limitation canceling means are constructed of a single electronic control unit which includes a microcomputer, an A/D converter, and a drive circuit.

7. The electronic throttle control apparatus according to claim 1, wherein the opening degree deviation calculation means calculates the opening degree deviation by adding the actual opening degree to the product of a derivative value and a derivative gain of the actual opening degree and subtracting an added result from the target opening degree, the control amount is a PIF control amount to be calculated by addition of a proportional term, an integral term, and a feed-forward term, the actuator control means converts the PIF control amount to a duty ratio by a predetermined function expression to control the actuator, the control gain includes a proportional gain and an integrating gain each being calculated according to the opening degree deviation, the control amount calculation means calculates the proportional term by multiplying the proportional gain by the opening degree deviation and calculates the integral term by accumulating the product of the integrating gain and the opening degree deviation, and the control amount calculation means calculates the feed-forward term according to the target opening degree by referring to a predetermined feed-forward term map which is set so that the feed-forward term is zero when the target opening degree is a middle opening degree, the feed-forward term becomes larger toward a predetermined plus value as the target opening degree is increased from the middle opening degree to a full opening direction, and the feed-forward term becomes smaller toward a predetermined minus value as the target opening degree is decreased from the middle opening degree to a full closed direction.

8. The electronic throttle control apparatus according to claim 7, wherein the control gain setting means sets the proportional gain to a predetermined gain for a steady operation when the opening degree deviation is in a steady state where the deviation is smaller than a predetermined value, and calculates the proportional gain according to the opening degree deviation by referring to a predetermined proportional gain map when the opening degree deviation is in a transitional state where the deviation is equal to or larger than the predetermined value, the proportional gain map being set constructed so that the proportional gain become smaller as the opening degree deviation becomes larger, and the control gain setting means sets the integrating gain to the gain for the steady operation when the opening degree deviation is in the steady state where it is smaller than a predetermined value, and calculates the integrating gain according to the opening degree deviation by referring to a predetermined integrating gain map when the opening degree deviation is in the transitional state where the deviation is equal to or larger than the predetermined value, the integrating gain map being set so that the integrating gain becomes smaller as the opening degree deviation becomes larger.

9. The electronic throttle control apparatus according to claim 7, wherein the throttle valve is rotatably supported in a bore of a throttle boy providing an intake passage of an engine, by a throttle shaft inserted through the bore, the actuator is a torque motor which directly operates the throttle shaft and the throttle valve without using a gear, the target opening degree setting means is an accelerator sensor for detecting an operation amount of an accelerator pedal by a driver as the target opening degree, the actual opening degree detection means is a throttle sensor for detecting an actual opening degree of the throttle valve, and the opening degree deviation calculation means, the control amount calculation means, the control gain setting means, the control gain limitation means, the actuator control means, the change speed detection means, and the limitation canceling meant are constructed of a single electronic control unit which includes a microcomputer, an A/D converter, and a drive circuit.

10. The electronic throttle control apparatus according to claim 8, wherein the throttle valve is rotatably supported in a bore of a throttle body providing an intake passage of an engine, by a throttle shaft inserted through the bore, the actuator is a torque motor which directly operates the throttle shaft and the throttle valve without using a gear, the target opening degree setting means is an accelerator sensor for detecting an operation amount of an accelerator pedal by a driver as the target opening degree, the actual opening degree detection means is a throttle sensor for detecting an actual opening degree of the throttle valve, and the opening degree deviation calculation means, the control amount calculation means, the control gain setting means, the control gain limitation means, the actuator control means, the change speed detection means, and the limitation canceling means are constructed of a single electronic control unit which includes a microcomputer, an A/D converter, and a drive circuit.

* * * * *